US009775489B1

(12) United States Patent
Ponkshe et al.

(10) Patent No.: US 9,775,489 B1
(45) Date of Patent: Oct. 3, 2017

(54) DOOR ASSEMBLY FOR A DISHWASHER

(71) Applicant: Whirlpool Corporation, Benton Harbor, MI (US)

(72) Inventors: Mihir Ponkshe, Pune (IN); Ajay Ram Narayana Pillai, St. Joseph, MI (US); Shivayogi Annigeri, Karnataka (IN); Michael E. Gatt, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 15/087,243

(22) Filed: Mar. 31, 2016

(51) Int. Cl.
*A47L 15/42* (2006.01)
*E06B 5/00* (2006.01)

(52) U.S. Cl.
CPC ..... *A47L 15/4265* (2013.01); *A47L 15/4263* (2013.01); *A47L 15/4293* (2013.01); *E06B 5/00* (2013.01); *A47L 15/4257* (2013.01)

(58) Field of Classification Search
None
See application file for complete search history.

(56) References Cited

U.S. PATENT DOCUMENTS 3,294,461 A * 12/1966 Barnard ..... A47L 15/4257 312/204
4,765,697 A 8/1988 Gardell et al.
5,453,586 A * 9/1995 Stottmann ..... H01H 13/70 200/302.2
7,014,281 B2 * 3/2006 Wuestefeld ..... A47L 15/4265 126/194
7,395,683 B2 * 7/2008 Kim ..... D06F 39/005 312/228
7,578,566 B2 8/2009 DiEnno et al.
7,770,985 B2 * 8/2010 Davis ..... E06B 3/7001 312/204
8,530,742 B2 * 9/2013 Hite ..... H05K 5/0017 174/50
8,716,631 B2 * 5/2014 Venezia ..... F24C 7/082 219/391
9,005,371 B2 4/2015 Egger et al.
2004/0201337 A1 * 10/2004 Wuestefeld ..... A47L 15/4265 312/311
2007/0159454 A1 7/2007 Rodriguez et al.
2009/0066205 A1 * 3/2009 Park ..... D06F 39/005 312/228

(Continued)

FOREIGN PATENT DOCUMENTS

EP 2465403 A2 6/2012
KR 20070088868 A 8/2007
KR 20150081747 A * 7/2015 ..... A47L 15/42

OTHER PUBLICATIONS http://www.repairclinic.com/PartDetail/Control-Panel/DD8201093A/3447469, Item Specification for Control Panel at repairclinic.com, Item 3447469, Samsung Part #DD82-01093A.

*Primary Examiner* — Joshua J Michener
*Assistant Examiner* — Kyle Walraed-Sullivan
(74) *Attorney, Agent, or Firm* — McGarry Bair PC

(57) ABSTRACT

A dishwasher has a tub that defines a treating chamber with an access opening. A door assembly selectively permits access to the treating chamber and may carry electronics for the dishwasher. Appropriately placed chamfered fins in a crown in the door aids in assuring a flush fit and finish in a front panel of the door assembly.

20 Claims, 13 Drawing Sheets

(56) References Cited

U.S. PATENT DOCUMENTS

| | | | | |
|---|---|---|---|---|
| 2010/0139717 | A1* | 6/2010 | Olesen | A47L 15/4257<br>134/56 D |
| 2010/0141103 | A1* | 6/2010 | Olesen | A47L 15/4257<br>312/228 |
| 2013/0300268 | A1* | 11/2013 | Schaefer | A47L 15/4265<br>312/228 |
| 2014/0033497 | A1* | 2/2014 | Schaefer | A47L 15/4246<br>29/428 |
| 2014/0373455 | A1* | 12/2014 | Haft | A47L 15/4261<br>49/381 |
| 2015/0173586 | A1* | 6/2015 | Kutto | A47L 15/4257<br>312/228 |
| 2015/0192288 | A1* | 7/2015 | Kim | A47L 15/42<br>362/253 |

* cited by examiner

DOOR ASSEMBLY FOR A DISHWASHER

BACKGROUND

Automatic dishwashers for use in a typical household include a tub defining a treating chamber and a spraying system for recirculating liquid throughout the tub to remove soils from the dishes and utensils. Two common configurations are a door-type, where a pivoting door provides access to a treating chamber where dishes are washed or a drawer-type where a drawer provides access to the as well as defining a major portion of the treating chamber. In either configuration, a rack for holding dishes to be cleaned is typically provided within the treating chamber.

A problem with some conventional door assemblies arises with fit and finish. For example, it is difficult to align a crown of the door assembly flush with side panels of the door, as shown schematically in FIG. 1. There exists a need to improve the fit and finish of appliances.

BRIEF DESCRIPTION

The present invention includes, in one embodiment, a dishwasher door assembly comprising a front panel having a front wall and spaced side walls extending from the front wall to define a substantially U-shaped cross section with an upper edge partially defining an upper opening, an inner panel spanning the side walls and having an upper edge partially defining the upper opening, a crown overlying the upper opening and having opposing upper and lower surfaces bounded by front and inner edges connected by spaced side edges, and tabs extending downward from the lower surface and spaced inward from the side edges by an amount substantially equal to the thickness of the upper edge along the side walls to define overhangs from the tabs to the side edges; wherein when the crown is mounted to the front panel, the tabs are received within the upper opening and in abutment with the side walls, the overhangs overlie the corresponding upper edge along the side wall, and the side edges are substantially flush with the side walls.

In another embodiment, the invention may include a dishwasher door assembly comprising a front panel having a front wall and spaced side walls extending from the front wall to define a substantially U-shaped cross section with an upper edge partially defining an upper opening, a crown overlying the upper opening and having a front edge and spaced side edges extending from the front edge, and tabs extending downward from a lower surface of the crown and into the upper opening and in abutment with the side walls, the tabs spaced inward from the side edges an amount such that the crown overlies the upper edge and the side edges are substantially flush with the side walls.

DESCRIPTION

Figure 1:
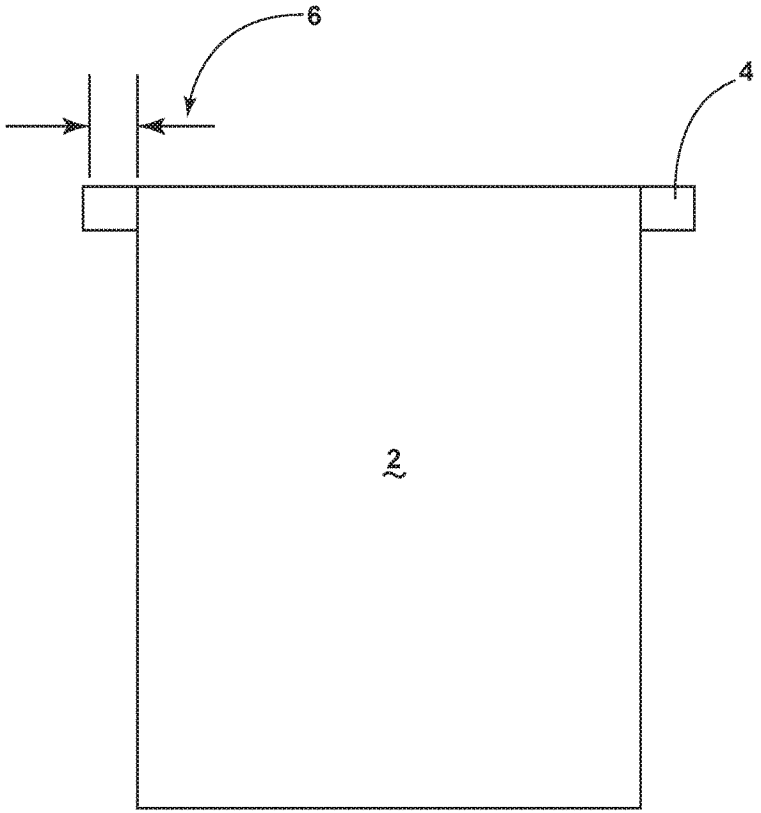
FIG. 1 (Prior Art)
FIG. 1 is a schematic representation of an overhang in a door assembly of a prior art dishwasher.

FIG. 1 is a schematic representation of an overhang in a door assembly of a dishwasher according to the prior art, with a front door panel 2. A crown 4 is affixed to the door panel resulting in an overhang 6.

Figure 2:
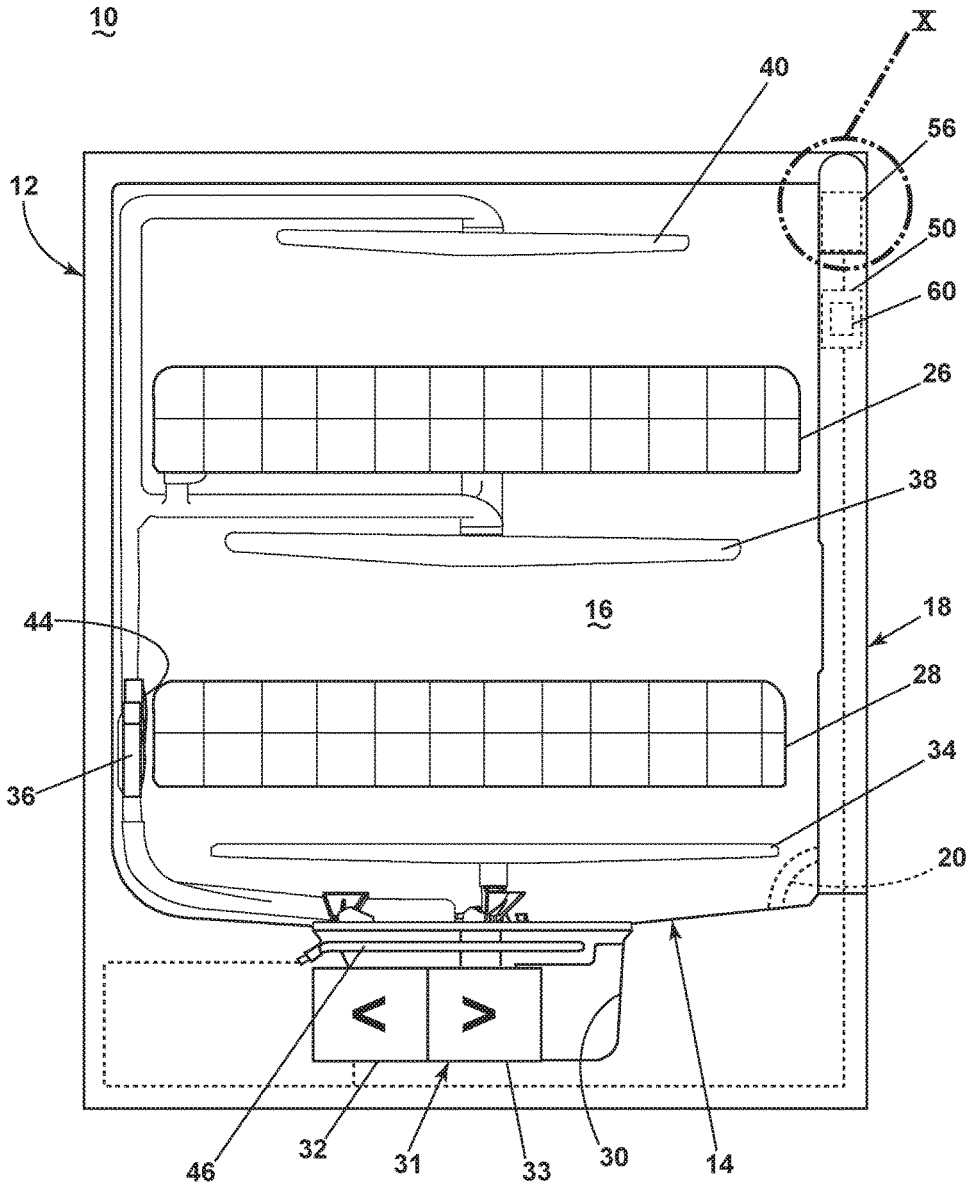
FIG. 2 is a schematic, cross-sectional view of a dishwasher of the type where aspects of the invention are applicable.

In FIG. 2, an automated dishwasher 10 according to a first embodiment is illustrated. The dishwasher 10 shares many features of a conventional automated dishwasher, which will not be described in detail herein except as necessary for a complete understanding of the invention.

A chassis 12 may define an interior of the dishwasher 10 and may include a frame, with or without panels mounted to the frame. An open-faced tub 14 may be provided within the chassis 12 and may at least partially define a treating chamber 16, having an open face, for washing dishes. A door assembly 18 may be movably mounted to the dishwasher 10 for movement between opened and closed positions to selectively open and close the open face of the tub 14. Thus, the door assembly provides accessibility to the treating chamber 16 for the loading and unloading of dishes or other washable items.

It should be appreciated that the door assembly 18 may be secured to the lower front edge of the chassis 12 or to the lower front edge of the tub 14 via a hinge assembly 20 configured to pivot the door assembly 18. When the door assembly 18 is closed, user access to the treating chamber 16 may be prevented, whereas user access to the treating chamber 16 may be permitted when the door assembly 18 is open.

Dish holders, illustrated in the form of upper and lower dish racks 26, 28, are located within the treating chamber 16 and receive dishes for washing. The upper and lower racks 26, 28 are typically mounted for slidable movement in and out of the treating chamber 16 for ease of loading and unloading. Other dish holders may be provided, such as a silverware basket. As used in this description, the term "dish(es)" is intended to be generic to any item, single or plural, that may be treated in the dishwasher 10, including, without limitation, dishes, plates, pots, bowls, pans, glassware, and silverware.

A spray system is provided for spraying liquid in the treating chamber 16 and is provided in the form of a first lower spray assembly 34, a second lower spray assembly 36, a rotating mid-level spray arm assembly 38, and/or an upper spray arm assembly 40. Upper sprayer 40, mid-level rotatable sprayer 38 and lower rotatable sprayer 34 are located, respectively, above the upper rack 26, beneath the upper rack 26, and beneath the lower rack 28 and are illustrated as rotating spray arms. The second lower spray assembly 36 is illustrated as being located adjacent the lower dish rack 28 toward the rear of the treating chamber 16. The second lower spray assembly 36 is illustrated as including a vertically oriented distribution header or spray manifold 44. Such a spray manifold is set forth in detail in U.S. Pat. No. 7,594,513, issued Sep. 29, 2009, and titled "Multiple Wash Zone Dishwasher," which is incorporated herein by reference in its entirety.

A recirculation system is provided for recirculating liquid from the treating chamber 16 to the spray system. The recirculation system may include a sump 30 and a pump assembly 31. The sump 30 collects the liquid sprayed in the treating chamber 16 and may be formed by a sloped or recess portion of a bottom wall of the tub 14. The pump assembly 31 may include both a drain pump 32 and a recirculation pump 33. The drain pump 32 may draw liquid from the sump 30 and pump the liquid out of the dishwasher 10 to a household drain line (not shown). The recirculation pump 33 may draw liquid from the sump 30 and the liquid may be simultaneously or selectively pumped through a supply tube 42 to each of the assemblies 34, 36, 38, 40 for selective spraying. While not shown, a liquid supply system may include a water supply conduit coupled with a household water supply for supplying water to the treating chamber 16.

A heating system including a heater 46 may be located within the sump 30 for heating the liquid contained in the sump 30.

The dishwasher door assembly 18 may also include a crown spacer 50. A controller 52 may also be included in the crown spacer 50, which may be operably coupled with various components of the dishwasher 10 to implement a cycle of operation. The controller 52 may be located within the crown spacer 50 as illustrated, or it may alternatively be located somewhere within the chassis 12. The controller 52 may also be operably coupled with a control panel or user interface 56 for receiving user-selected inputs and communicating information to the user. The user interface 56 may include operational controls such as dials, lights, switches, and displays enabling a user to input commands, such as a cycle of operation, to the controller 52 and receive information.

Figure 3:
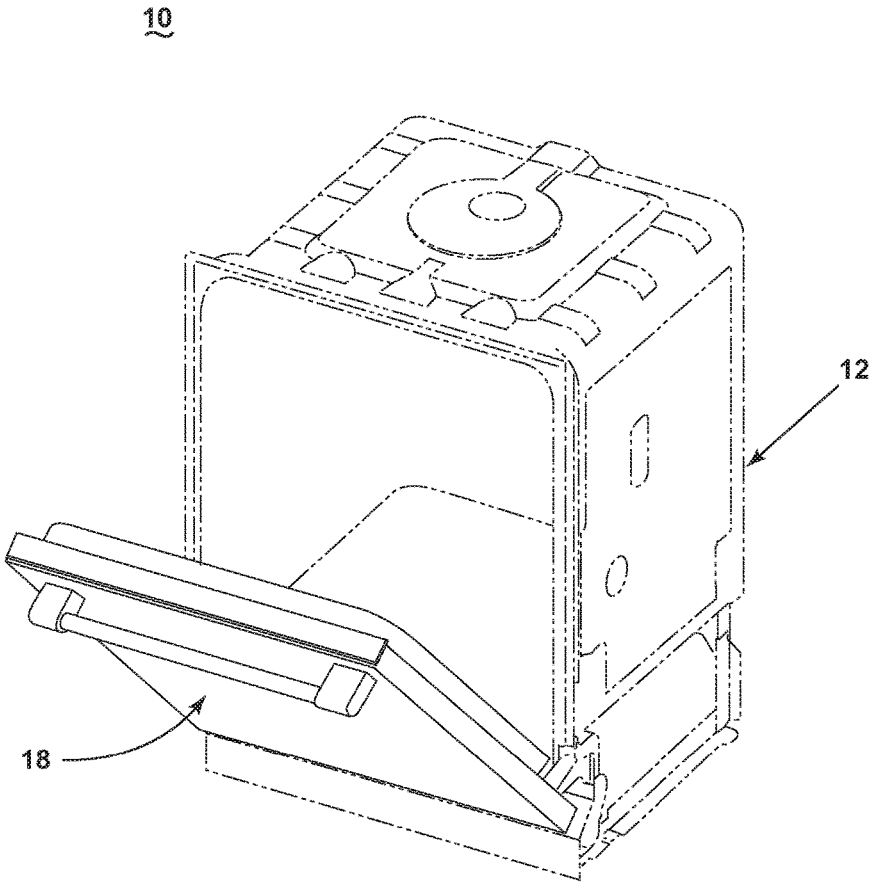
FIG. 3 is an isometric view of the dishwasher of FIG. 2 showing relative positions of a chassis and an open door assembly.

FIG. 3 shows an isometric view of the dishwasher 10 according to an embodiment of the current invention with a partially open door assembly 18. The other components of the dishwasher inside the chassis 12 have not been shown here.

Figure 4:
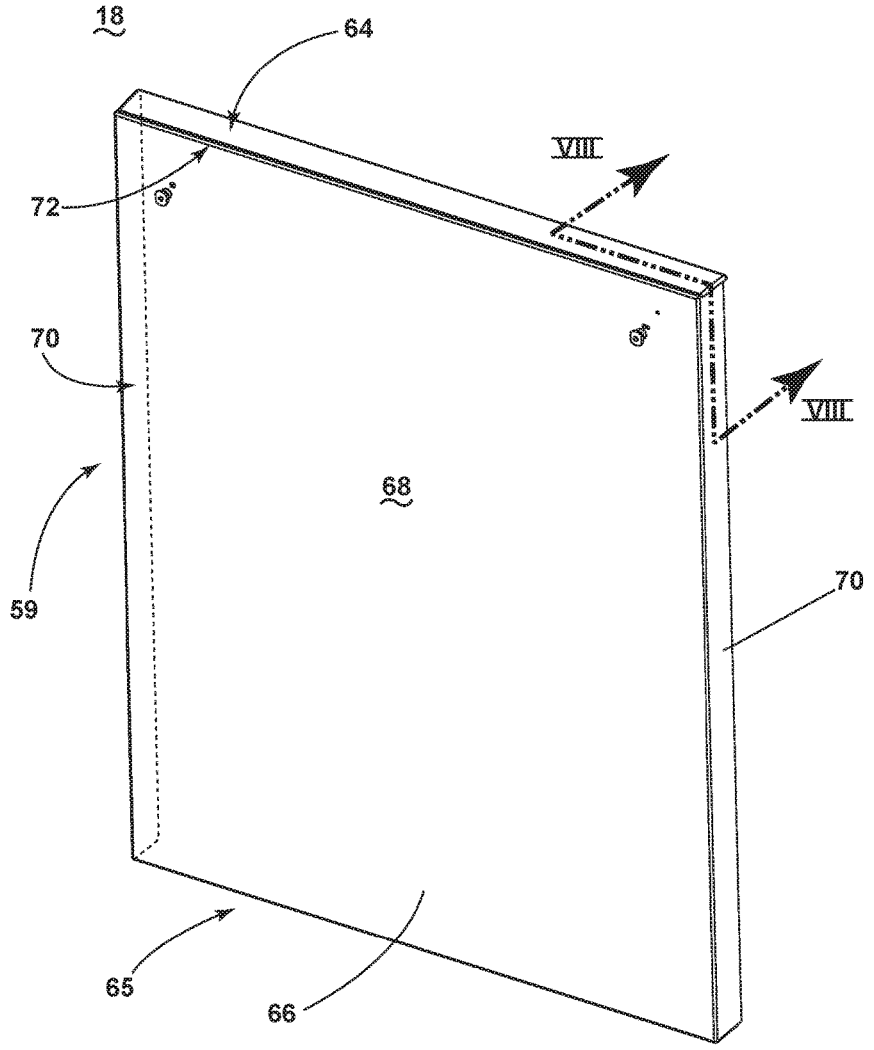
FIG. 4 is an isometric view of the door assembly of FIG. 3.
Figure 5:
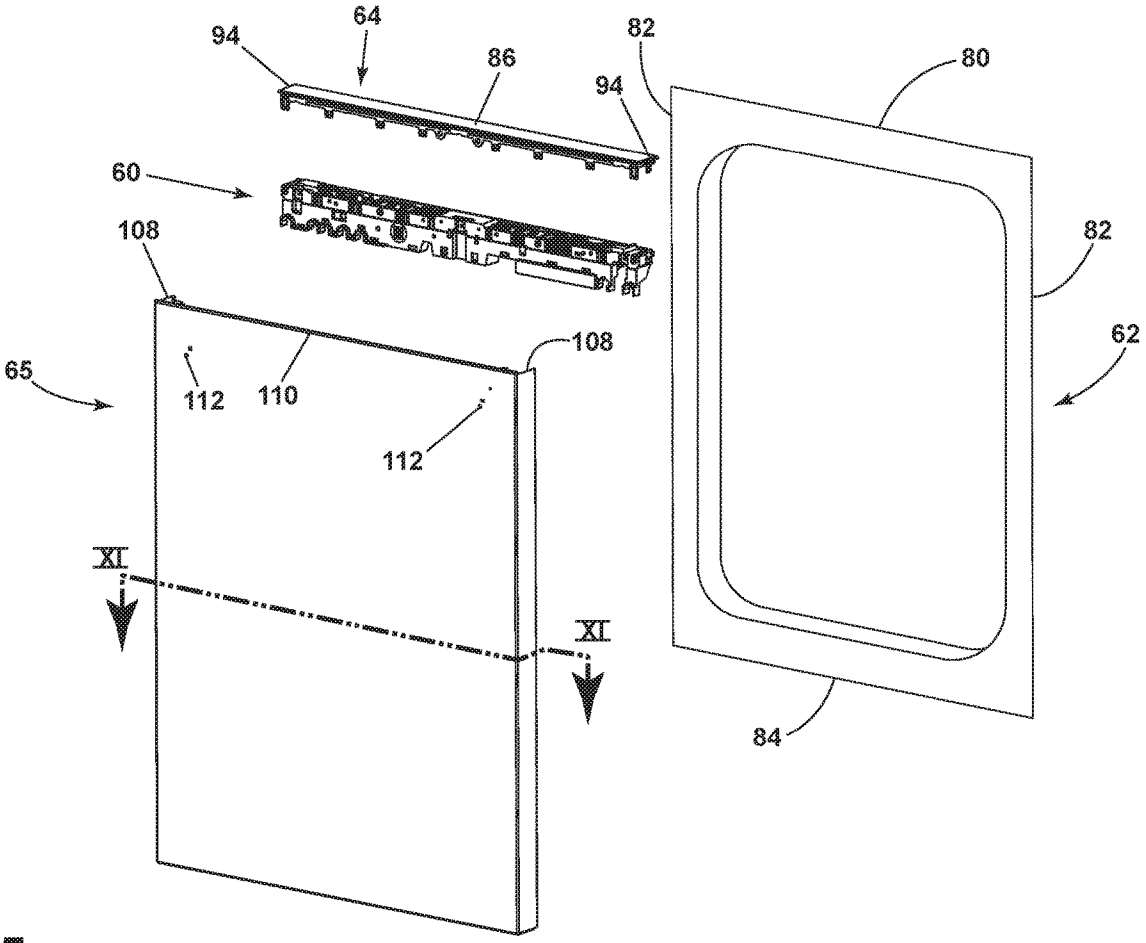
FIG. 5 is a front exploded view of the door assembly of FIG. 4 according to a first embodiment of the invention.
Figure 5A:
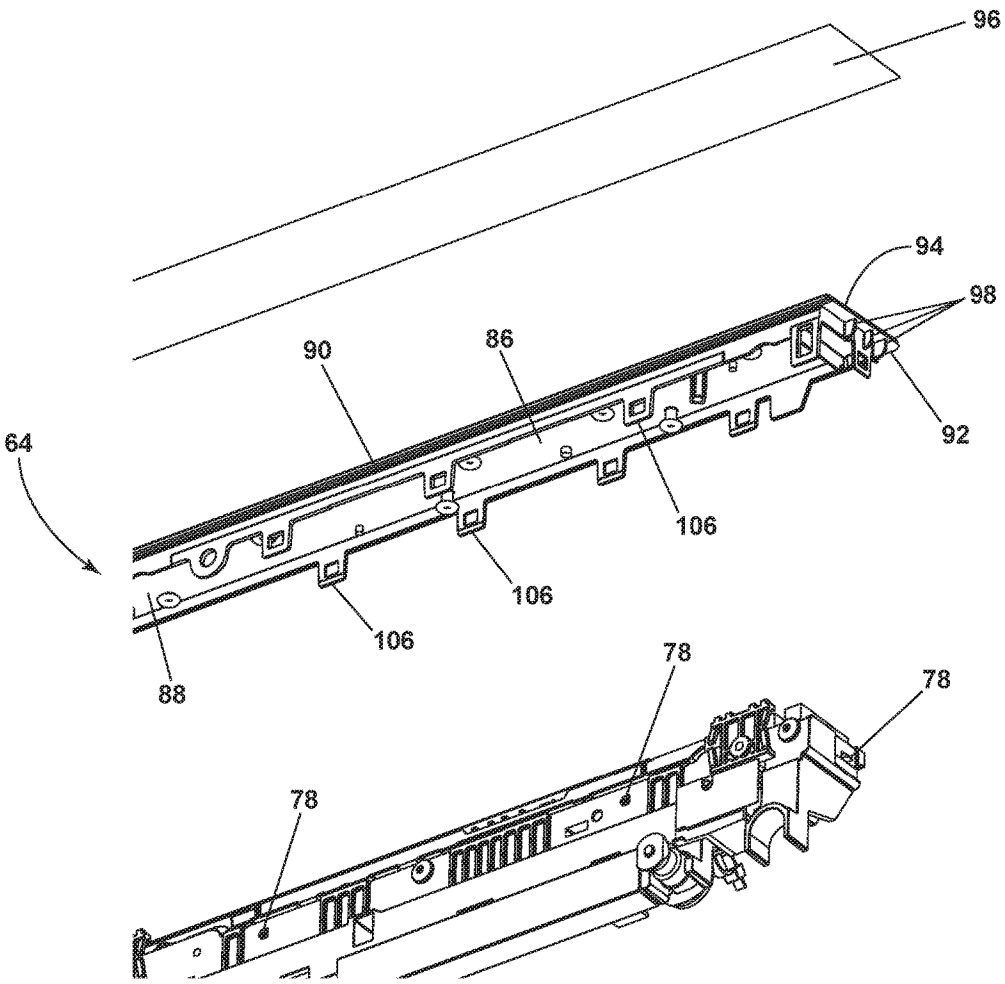
FIG. 5A is an enlarged view of FIG. 5, focusing on a fascia, a crown, and a crown spacer.

In a first embodiment of the invention as shown in FIG. 4, the door assembly 18 comprises four distinct components, i.e.: a front panel 65, the crown spacer 60 (shown in FIG. 5), an inner panel 62 (shown in FIG. 5) and a crown 64. The front panel 65 includes a front wall 66 with an outside surface 68, and side walls 70 that extend from the front wall 66 away from the outside surface 68, thereby lending the front wall 66 a U shape in cross-section. The front wall 66 at an upper edge 72 thereof has a return flange 274 (shown in FIG. 6) extending away from the outside surface 68. The return flange 274 terminates in a rear edge 276. The crown spacer 60 comprises various electrical components and a housing for the same. The crown spacer 60 also comprises protrusions 78 positioned at various points along its outer surfaces as shown in FIG. 5A The inner panel 62 is a flat, rectangular structure of a width that is substantially equal to the distance between the side walls 70 of the front panel 65, and height substantially equal to the height of the front panel 65. The inner panel 62 comprises an upper edge 80, two side edges 82, and a bottom edge 84. The upper edge 80 of the inner panel 62 abuts the crown 64 along the entire length of the upper edge 80 after assembly is complete.

Figure 7:
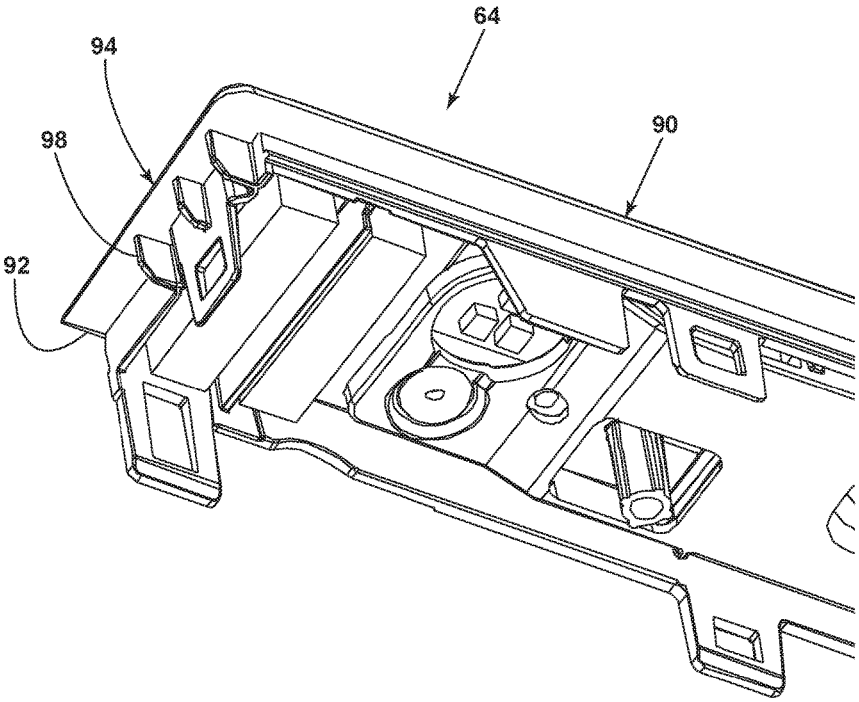
FIG. 7 is an enlarged view of a portion of a crown assembly in FIG. 5A
Figure 8:
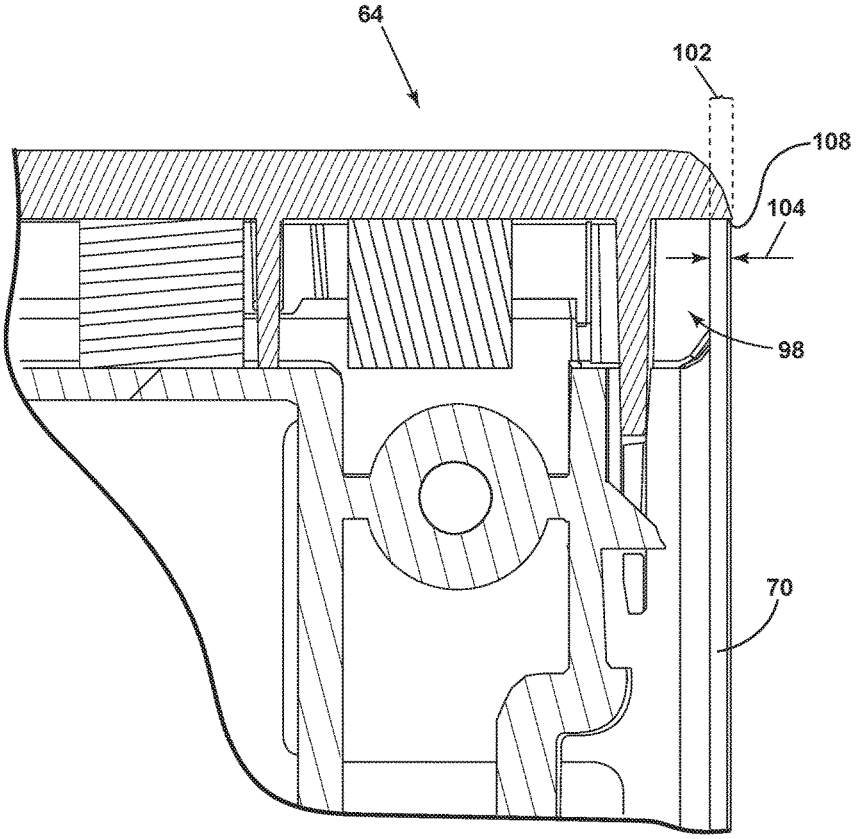
FIG. 8 is a partial front cross sectional view of the crown assembly, taken along section VIII-VIII of FIG. 4, according to the first embodiment of the invention.

The crown 64 comprises a crown top surface 86 and a crown bottom surface 88, both bounded by a front edge 90, an inner edge 92 and spaced side edges 94 extending between the front edge 90 and the inner edge 92. The crown top surface 86 may have a fascia 96 that includes the user interface or display 56. The crown 64 has depending spacer tabs 98 along each side edge, that are placed inward from the side edge, by a distance 102 substantially equal to the thickness 104 of the upper edge along the side walls (70) as shown in FIG. 8. These spacer tabs 98, extending from the crown 64 in a direction away from the crown top surface 86, may have chamfered outer and distal surfaces comprising rounded corners as shown in FIG. 7. The crown also comprises several interlocking tabs 106 present along the front edge 90 and the inner edge 92 extending in a direction away from the crown top surface 86, at positions corresponding to the positions of the protrusions 78 on the crown spacer. The protrusions 78 and the interlocking tabs 106 together form a locking assembly.

Figure 10:
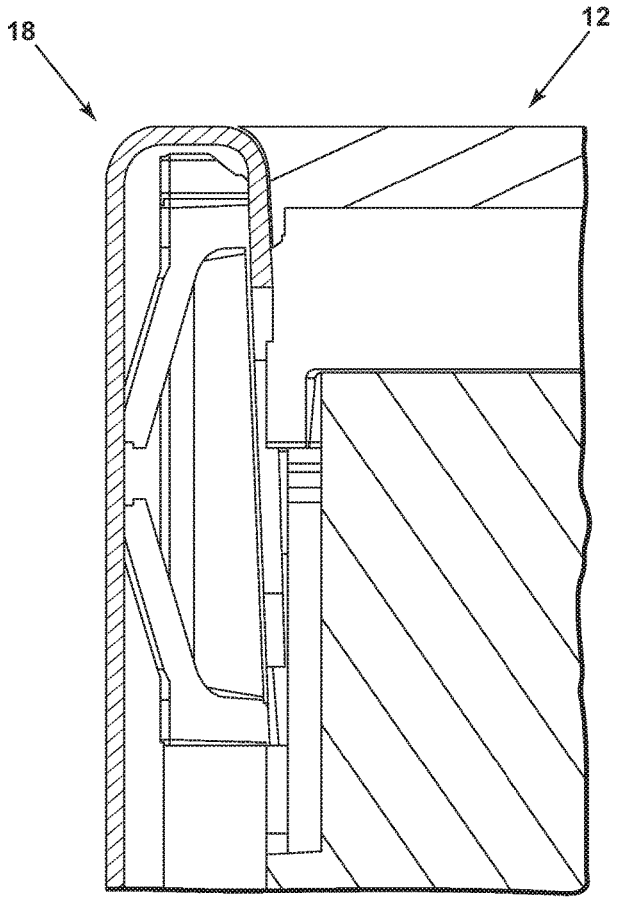
FIG. 10 is a partial enlarged side cross sectional view of the dishwasher of FIG. 3 with the door closed, according to a third embodiment.
Figure 11:
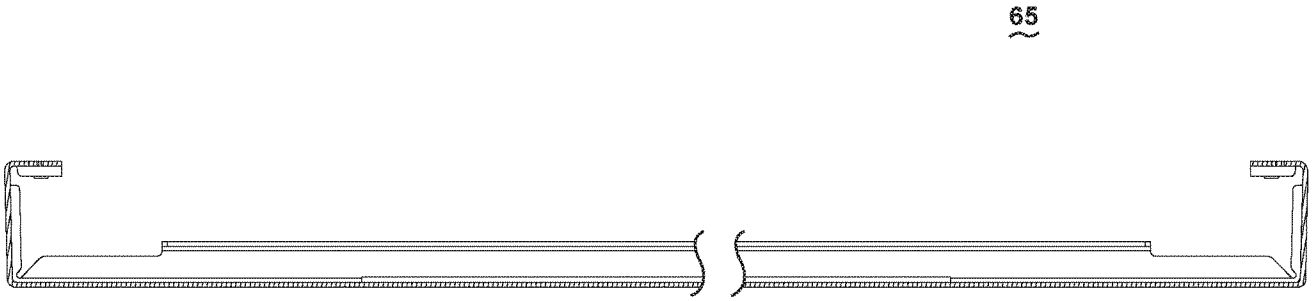
FIG. 11 is a cross sectional view of the front panel of the dishwasher door assembly of FIG. 5, according to 11-11'.

The front edge of the crown and the rear edge of the front wall each may be curved and complementary such that the front edge overlaps the rear edge as shown in FIG. 10.

In assembly, the inner panel 62 is fitted to the front panel 65 such that it spans the gap between the two side walls 70 of the front panel. The opening thus defined by the upper edges 108 of the side walls (70), the upper edge of the front panel 65 and the upper edge 80 of the inner panel (62), is referred to henceforth as the upper opening. The crown spacer 60 is then fitted into the upper opening and held in place by screws 112. Finally, the crown 64 is fitted over the front and the inner panels such that it covers the crown spacer 60. In this position, the spacer tabs 98 along the side edges 94 press against the side walls 70, thereby flexing the side walls 70 in a direction away from each other, reducing overhang. The interlocking tabs 106 snap into place once they go past the corresponding protrusions 78 on the crown spacer 60 when the crown 64 is fitted, thereby keeping the crown 64 in place.

Figure 5B:
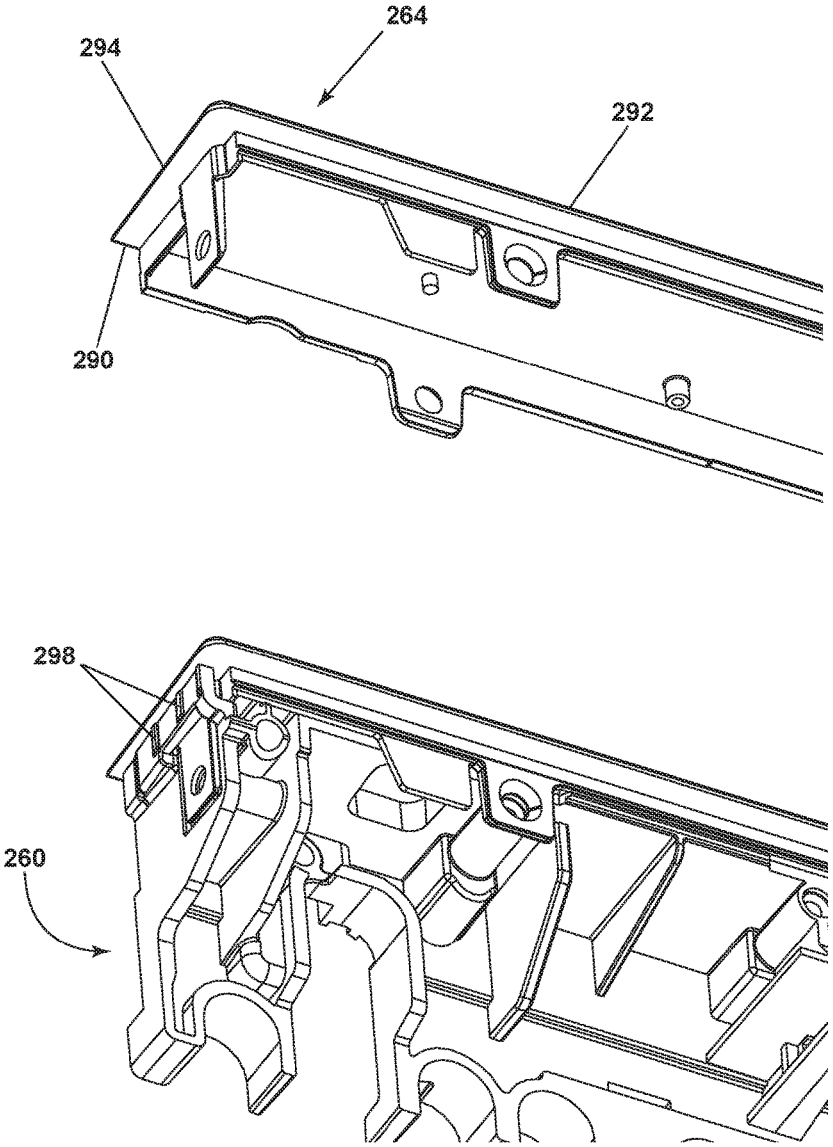
FIG. 5B is an enlarged rear exploded view of the door assembly of FIG. 4, according to a second embodiment of the invention, focusing on the crown and the crown spacer.
Figure 6:
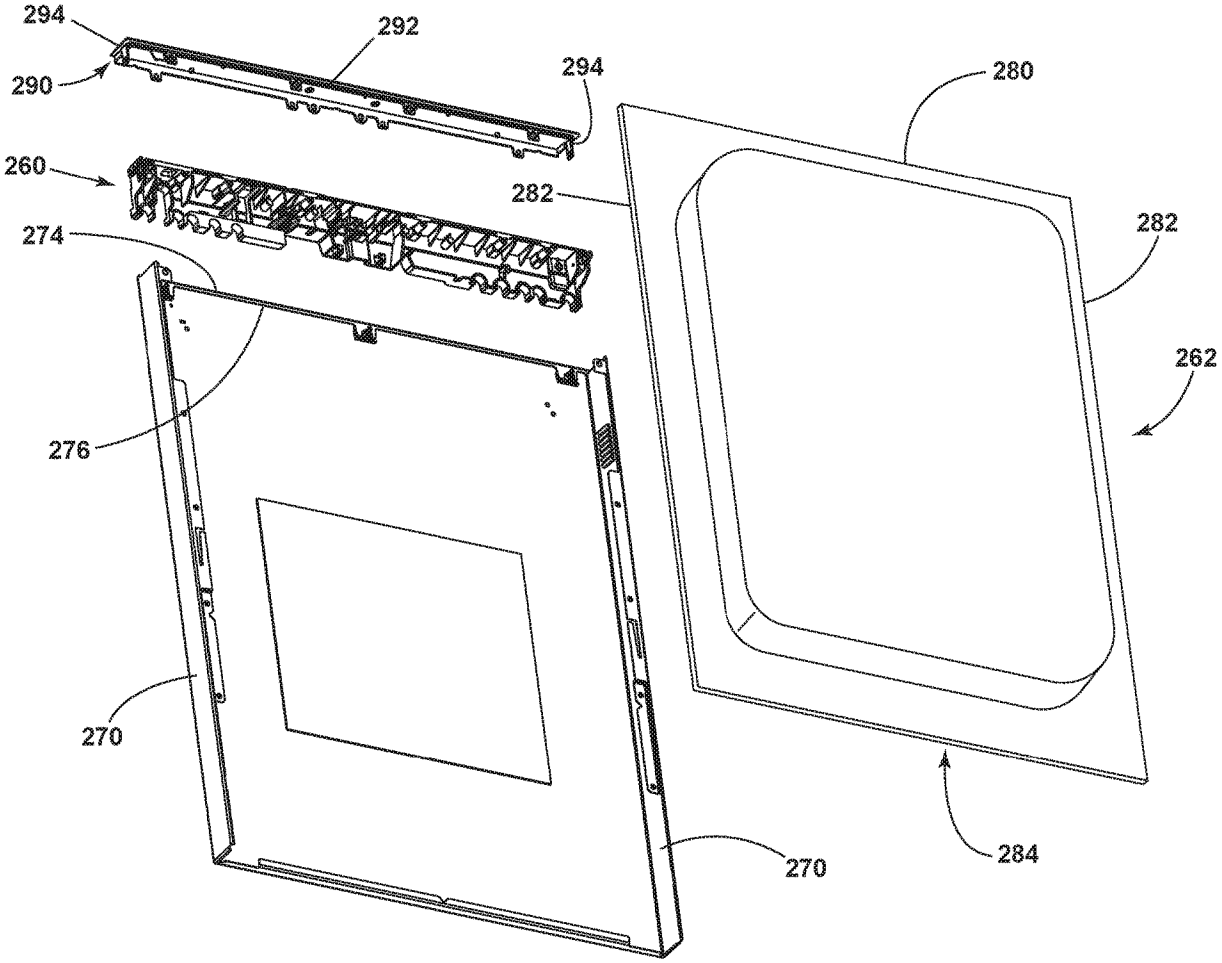
FIG. 6 is a rear exploded view of the door assembly of FIG. 4, according to the second embodiment of the invention.
Figure 9:
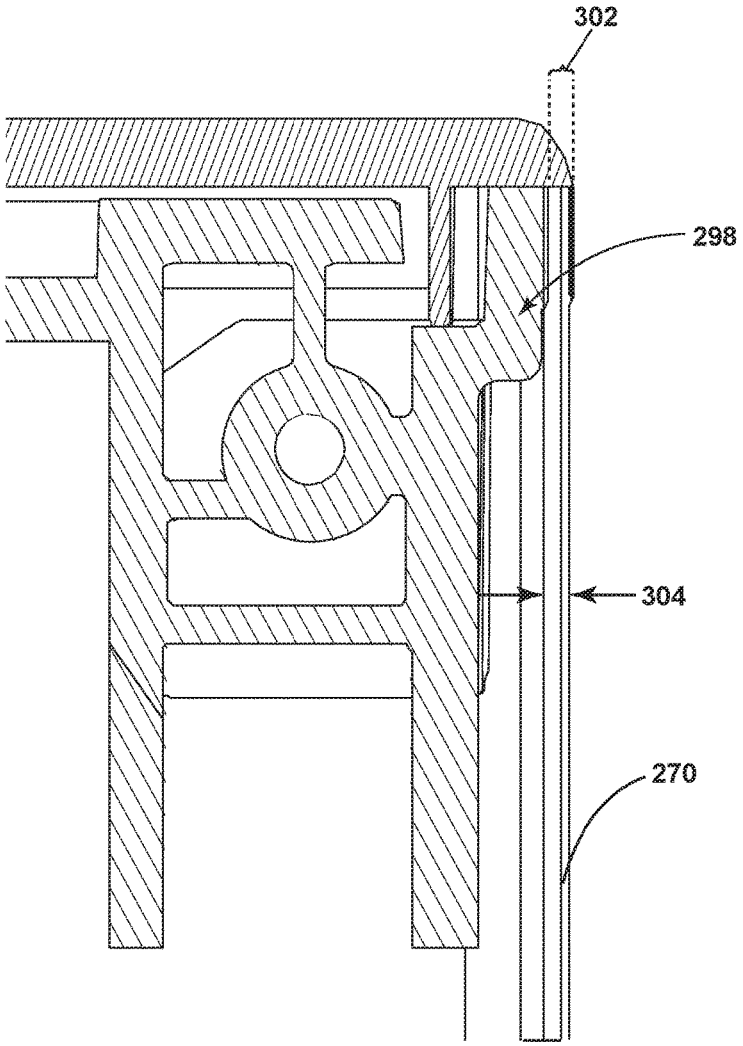
FIG. 9 is a partial front cross sectional view of the crown assembly, taken along section IX-IX of FIG. 4, according to the second embodiment of the invention.

A second embodiment of the invention is contemplated in FIGS. 5B, 6, 9. FIGS. 2, 3, 4, 10, 11 are common to both embodiments. The second embodiment is similar to the first embodiment. Therefore, like parts will be identified with like numerals increasing by 200, with it being understood that the description of the like parts of the first embodiment applies to the additional embodiments, unless otherwise noted. The crown spacer 260 comprises various electrical components and the housing for the same. The crown spacer 260 also has spacer tabs 298 along the sides, extending away from the crown spacer 260 as shown in FIG. 5B. The spacer tabs 298 along the sides of the crown spacer 260 may have chamfered outer and distal surfaces comprising rounded corners. The spacer tabs 298 are dimensioned such that the any overhang of the crown (302) is substantially equal to the thickness of the upper edge along the side walls (270).

To the extent not already described, the different features and structures of the various embodiments may be used in combination with each other as desired. That one feature may not be illustrated in all of the embodiments is not meant to be construed that it may not be, but is done for brevity of description. Thus, the various features of the different embodiments may be mixed and matched as desired to form new embodiments, whether or not the new embodiments are expressly described. All combinations or permutations of features described herein are covered by this disclosure.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention, which is defined in the appended claims.

What is claimed is:

1. A dishwasher door assembly comprising:

a front panel having a front wall and spaced side walls extending from the front wall to define a substantially U-shape cross section with an upper edge partially defining an upper opening, wherein the spaced side walls extend along a length of the front wall and define outermost walls of the front panel; and a crown overlying the upper opening and having a front edge and spaced side edges extending from the front edge, and tabs extending downward from a lower surface of the crown and into the upper opening, the tabs having a length such that the tabs are in contact with an innermost surface of the side walls, beneath the upper edge;

wherein the tabs are spaced inward from the side edges an amount such that the crown overlies the upper edge and an outermost edge of the side edge aligns with an outermost edge of the side wall such that the side edges are substantially flush with the side walls.

2. The dishwasher door assembly of claim 1, further comprising an inner panel spanning the side walls and having an upper edge partially defining the upper opening, wherein the front panel comprises a return flange extending from the front wall toward the inner panel and terminating in a rear edge adjacent the front edge of the crown.

3. The dishwasher door assembly of claim 2 wherein the front edge and the rear edge are complementary in shape.

4. The dishwasher door assembly of claim 3 wherein the complementary shapes are arcuate.

5. The dishwasher door assembly of claim 4 wherein at least a portion of the front edge overlies the rear edge.

6. The dishwasher door assembly of claim 1 wherein the tabs comprise multiple spaced flanges.

7. The dishwasher door assembly of claim 1 wherein the tabs comprise a chamfer distal from the lower surface.

8. The dishwasher door assembly of claim 7 wherein the chamfer comprises a rounded corner.

9. The dishwasher door assembly of claim 1 wherein the crown comprises a fascia for a user interface.

10. A dishwasher door assembly comprising:

a front panel having a front wall and spaced side walls extending from the front wall to define a substantially U-shape cross section with an upper edge partially defining an upper opening;

an inner panel spanning the side walls and having an upper edge partially defining the upper opening;

a crown spacer disposed between the front panel and the inner panel, adjacent the upper opening; and a crown overlying the crown spacer and the upper opening and having opposing upper and lower surfaces bounded by front and inner edges connected by spaced side edges, and tabs extending downward from the lower surface and spaced inward from the side edges an amount substantially equal to the thickness of the upper edge along the side walls to define overhangs from the tabs to the side edges;

wherein when the crown is mounted to the front panel, the tabs are received within the upper opening and in contact with an in surface of the side walls, beneath the upper edge, the overhangs overlie the corresponding upper edge along the side wall, and an outermost edge of the side edge aligns with an outermost edge of the side wall such that the side edges are substantially flush with the side walls.

11. The dishwasher door assembly of claim 10 wherein the front panel comprises a return flange extending from the front wall toward the inner panel and terminating in a rear edge adjacent to the front edge of the crown.

12. The dishwasher door assembly of claim 11 wherein the front edge and the rear edge are complementary in shape.

13. The dishwasher door assembly of claim 12 wherein the complementary shapes are curved.

14. The dishwasher door assembly of claim 12 wherein at least a portion of the front edge overlies the rear edge.

15. The dishwasher door assembly of claim 10 wherein the tabs comprise multiple spaced flanges.

16. The dishwasher door assembly of claim 15 wherein the multiple spaced flanges have a chamfered outer surface.

17. The dishwasher door assembly of claim 16 wherein the chamfered outer surface comprises a rounded corner.

18. The dishwasher door assembly of claim 10 wherein the tabs comprise a chamfer distal from the lower surface.

19. The dishwasher door assembly of claim 18 wherein the chamfer comprises a rounded corner.

20. The dishwasher door assembly of claim 10 wherein the crown comprises at least one of a fascia for a user interface or a display.

* * * * *